US006595866B1

(12) United States Patent
McDaniel et al.

(10) Patent No.: US 6,595,866 B1
(45) Date of Patent: Jul. 22, 2003

(54) GOLF AID

(76) Inventors: Joseph M. McDaniel, 7130 Leighton Rd., Columbus, GA (US) 31904; William Dawahare, 7358 Winding Ridge Rd., Columbus, GA (US) 31904

( * ) Notice: Subject to any disclaimer, the term of this patent is extended or adjusted under 35 U.S.C. 154(b) by 0 days.

(21) Appl. No.: 10/102,957

(22) Filed: Mar. 22, 2002

(51) Int. Cl.[7] ..... A63B 53/06; A63B 53/16; A63B 69/36

(52) U.S. Cl. ..... 473/261; 473/266; 473/257

(58) Field of Search ..... 473/257, 260, 473/261, 262, 263, 278, 219, 231, 266, 264, 271, 270, 237, 258, 265, 226, 218, 238, 259, 268, 452, 58, 134, 139, 143, 145, 146, 217, 229, 42, 190, 222, 252, 253, 254, 491, 492, 493, 494, 162; D21/791; 33/508, 286, 279, 415, 427, 429, 438, 491, 483, 484, 485, 486, 487; 482/25, 34, 38, 39, 143; 108/50.01

(56) References Cited

U.S. PATENT DOCUMENTS 1,484,064 A * 2/1924 Erickson et al. ..... 473/218
1,511,599 A * 10/1924 Fergusson ..... 446/487
1,545,648 A * 7/1925 Fletcher ..... 473/218
2,375,150 A * 5/1945 Townsend ..... 33/491
2,575,668 A * 11/1951 Lemoyne ..... 473/218
3,697,080 A 10/1972 Liotta
3,985,353 A * 10/1976 Vosberg ..... 482/16
4,105,201 A * 8/1978 L'Ecuyer et al. ..... 482/34
4,718,674 A * 1/1988 Henry ..... 473/218
5,007,646 A 4/1991 Baber et al.
5,024,442 A * 6/1991 Sindelar, Sr. ..... 473/261
5,072,943 A * 12/1991 Sindelar ..... 473/251
5,224,709 A 7/1993 Buck, Jr.
5,314,186 A * 5/1994 Lee ..... 473/218
5,350,177 A 9/1994 Furbush, Jr.
5,388,833 A * 2/1995 Goyen, Jr. ..... 473/218
5,415,407 A * 5/1995 Beatty ..... 473/409
6,440,004 B1 * 8/2002 Rodriguez ..... 473/218
6,500,075 B1 * 12/2002 McDevitt ..... 473/272

* cited by examiner

*Primary Examiner*—Paul T. Sewell
*Assistant Examiner*—Alvin A. Hunter, Jr.
(74) *Attorney, Agent, or Firm*—Richard C. Litman

(57) ABSTRACT

A golf aid having a horizontally elongated body with a top surface, bottom surface, front surface, back surface and two opposing end surfaces. A plurality of lines are disposed upon the front, top and back surfaces. Two holes located adjacent to each end are defined between the top and bottom surfaces. The vertical element of a stabilizer having a vertical element and a horizontal element is inserted into each hole. The stabilizers are capable of rotating between a support position and a storage position.

7 Claims, 3 Drawing Sheets

GOLF AID

BACKGROUND OF THE INVENTION

1. Field of the Invention

The present invention relates to sports equipment, in particular to a golf aid used for training to correct or improve a golf swing.

2. Description of the Related Art

The game of golf is enjoyed by millions of people across the world. Unfortunately, while golf is enjoyed by many it is played well by comparatively few. This disparity has led to the development of a great number of game improvement devices over the years. Some of the most successful of these improvement devices, like the present invention, focus on the most fundamental element of golf, the swing. The speed of a golf swing, which can be in excess of 110 mph, can make determining the path the club head is traveling difficult to ascertain. The golf aid assists a golfer in visualizing his or her proper swing path and gives the golfer feedback if his or her swing deviates therefrom.

A variety of swing trainers have been developed over the years but none are as easy to use, as durable, as lightweight, or as effective as the present invention. For example U.S. Pat. No. 3,697,080 to Liotta discloses a longitudinally elongated upright support member made of wood and includes a number of slots in the support member. Tabs inserted into the slots serve as elevated targets for the golfers club head on the back swing, forward swing and a follow through. The '080 patent is distinguishable from the present invention because the present invention lacks slots and tabs, is made of lightweight materials, and has folding support feet. The support feet allow the present invention to be used on the entire golf course, including on the green as a putting aid.

U.S. Pat. No. 5,007,646 to Baber et al. discloses a golf putting practice device which includes an elongated base that has a generally vertical, planar, putter guide surface. A number of grooves on the top of the base allow for the positioning of a sight above a ball before putting. The '646 invention can be distinguished from the present invention in that, due to the position of the sight, the '646 invention cannot be used for full swing training. The '646 also lacks the light weight and the retractable feet of the present invention, which allow it to be used on the golf course.

U.S. Pat. No. 5,224,709 to Buck Jr. discloses a golf apparatus for correcting a golfer's slice. The device has a base which is attached to a spring-biased, pivotal, swing guide wall. The '709 invention differs from the present invention in that the present invention has no attached base, is made of lightweight materials, and is easily portable, unlike the invention disclosed in the '709 patent.

U.S. Pat. No. 5,350,177 to Furbush, Jr. discloses a collapsible golf swing training apparatus. The apparatus has two parallel adjustable rails, each having a vertical swing fence. The '177 invention differs from the present invention, among other ways, in that it uses two club guides, it has no extendable feet, and it is not constructed of materials suitable for easy transport/travel.

None of the above inventions and patents, taken either singularly or in combination, is seen to describe the instant invention as claimed. Thus a golf aid solving the aforementioned problems is desired.

SUMMARY OF THE INVENTION

The present invention is a golf aid which is designed to train a golfer to swing the golf club head straight through the golf ball at impact. This goal is achieved by giving the golfer feedback during swings that come from the outside in (slice) or the inside out (hook). The golf aid has a horizontally elongated body that is rectangular in cross section. It has two stabilizers that extend laterally from its bottom surface and support the body. The body is made of a lightweight durable plastic that will not mar golf club heads.

The golf aid is positioned adjacent to a golf ball and oriented parallel to the intended path of the ball, on the side of the ball opposite the golfer. Contact of the golf aid with the club head during a swing indicates an improper swing path as discussed above. The light weight construction and laterally extending stabilizers allow the golf aid to be used not only on the driving range, but also on the varying slopes and conditions of the golf course itself.

Accordingly, it is a principal object of the invention to perfect a golfer's swing technique.

It is another object of the invention to provide a lightweight, durable golf aid.

It is a further object of the invention to provide a golf aid that is useable both on the driving range and on the golf course.

Still another object of the invention is to provide a golf aid which can be used to help visualize the perfect stroke for driving, pitching, chipping, and putting.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
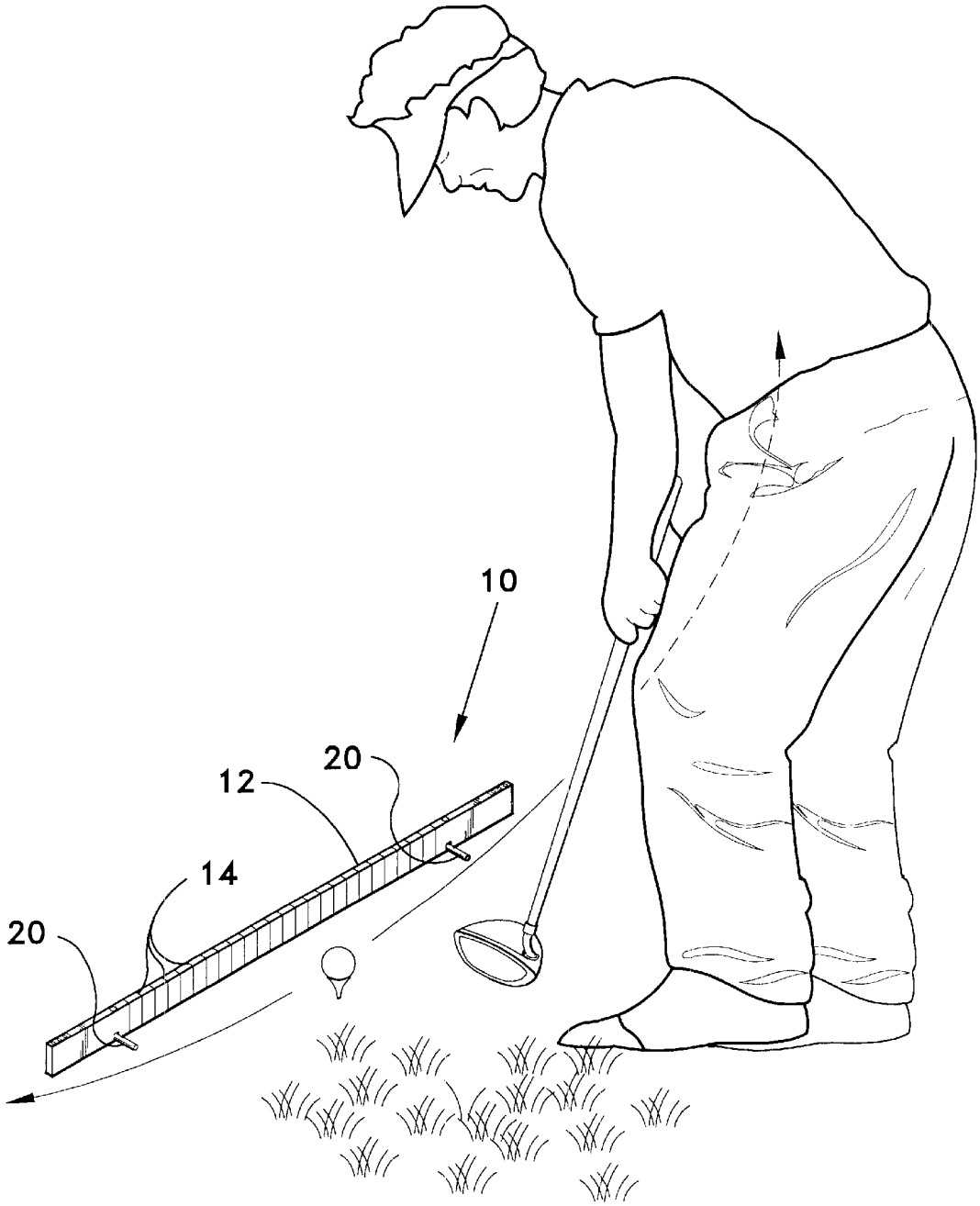
FIG. 1 is an environmental, perspective view of a golf aid according to the present invention.
Figure 2:
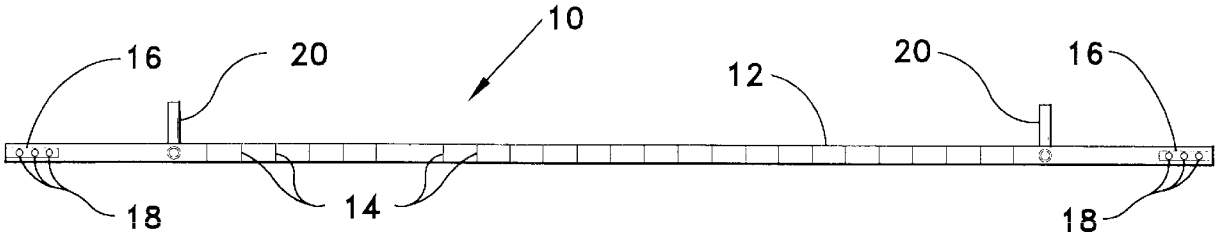
FIG. 2 is a top view of a golf aid according to the present invention.

The present invention is a golf aid 10. As shown in FIG. 1, the golf aid 10 is designed to guide a golfer's swing so as to produce a proper swing path. A proper swing path will result in the elimination of undesirable ball flight characteristics, such as hooking and slicing. The golf aid 10 has a horizontally extending body 12 with a top surface, bottom surface, front surface, back surface and two opposing end surfaces. The body 12 may be constructed of any lightweight, high strength material that will not mar a club face. The preferred material is a high-density structural foam polyethylene. A plurality of alignment stripes 14 are disposed upon the front, top and rear surfaces of the body 12. The alignment stripes 14 are preferably spaced one inch apart from one another and serve as a guide for squaring the club face FIG. 2 shows the top of the golf aid. This view clearly shows the optional golf tee channel 16 and the associated holes 18 defined therein. Golf tees may be inserted into and stored in the holes 18 for later use during play.

Figure 3:
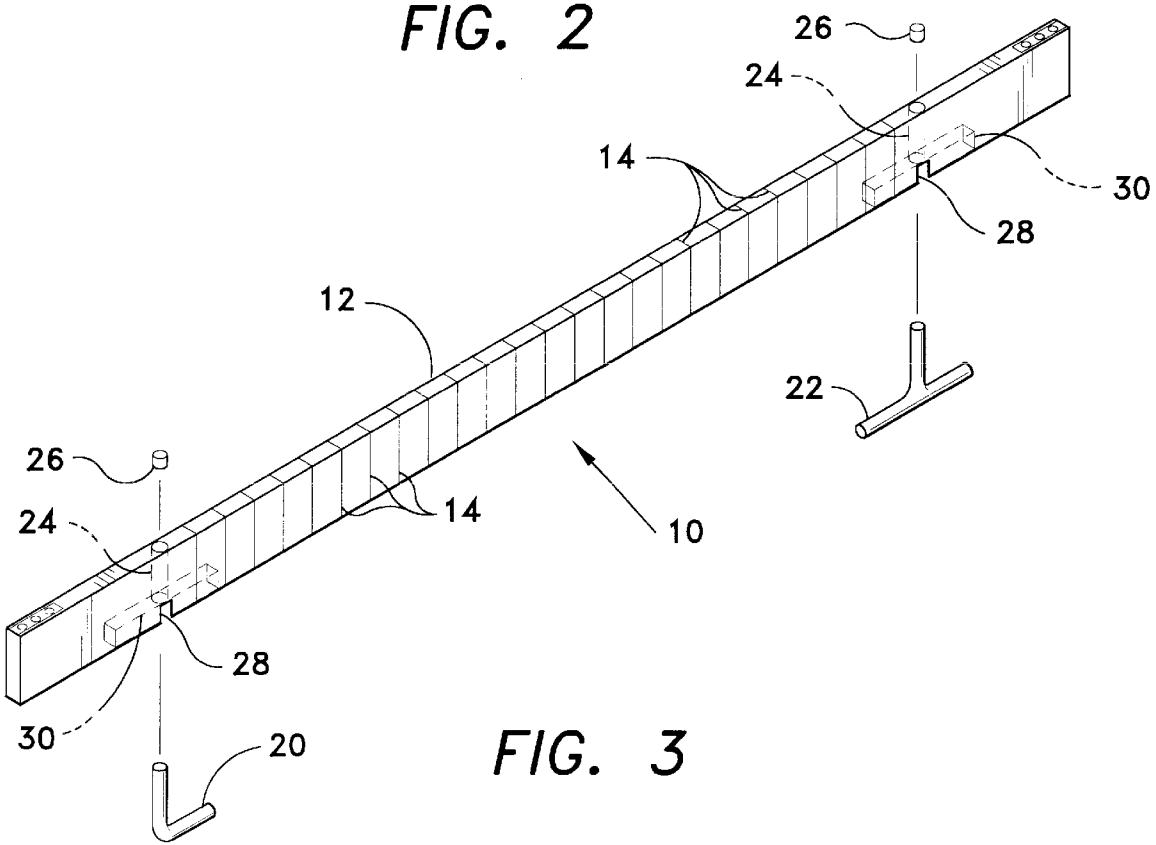
FIG. 3 is a front view of a golf aid according to the present invention.

FIG. 3 shows two types of stabilizers 20, 22 which may be used with the golf aid 10. The first type of stabilizer 20 is L-shaped and has a vertical element and a horizontal element. The vertical element is inserted into a channel 24 defined between the top surface and the bottom surface of the body 12. A cap 26 attaches to the end of the vertical element 20 and secures the stabilizer 20 in the channel 24.

The horizontal element of the stabilizer 20 may be rotated between a support position normal to the front or rear surface of the body 12 shown in FIG. 2 and a storage position parallel to the front and rear surfaces of the body 12. A lock channel 28 defined in the bottom surface of the body 12 secures the horizontal element of the stabilizer in the support position and a storage channel 30 secures horizontal element of the stabilizer when in the storage position. FIG. 3 also depicts a second type of stabilizer 22 that is T-shaped and functions in the same manner as the L-shaped stabilizer.

Figure 4:
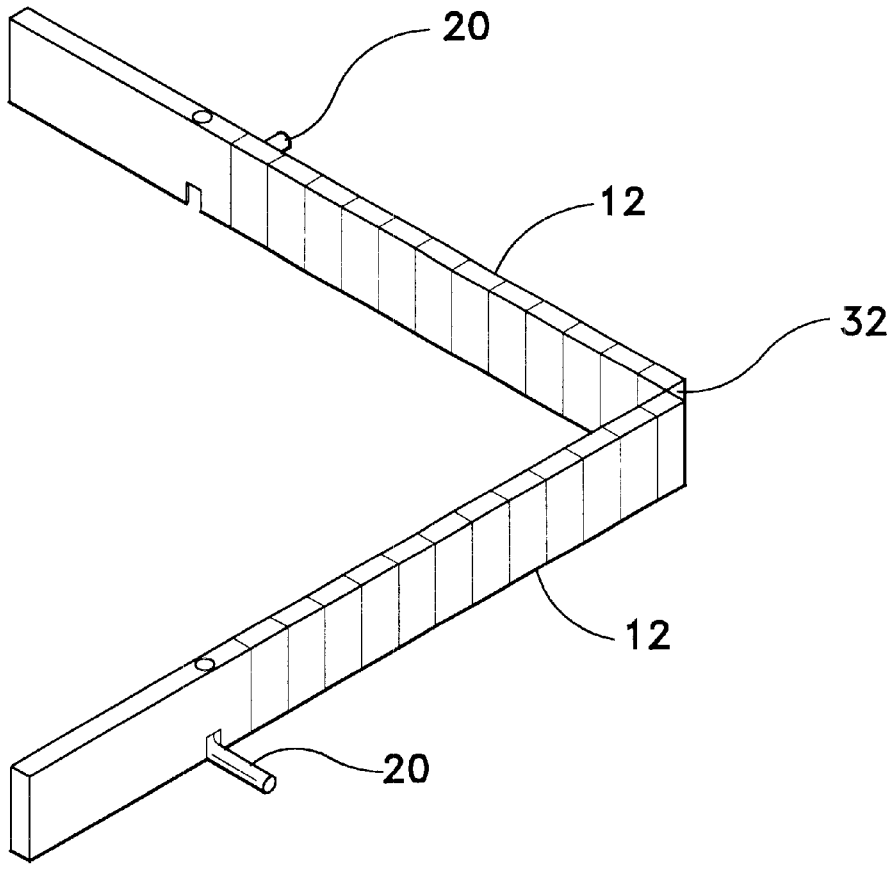
FIG. 4 is a perspective view of the second embodiment of the present invention.

FIG. 4 depicts a second embodiment of the golf aid. The body 12 of this embodiment has been cut into two pieces and the two pieces have been secured together with a hinge 32. The hinge functions to allow the pieces of the body to be folded together and thereby reduce the overall length of the body 12 by one half.

It is to be understood that the present invention is not limited to the embodiments described above, but encompasses any and all embodiments within the scope of the following claims.

We claim:

1. A golf aid, comprising:

a horizontally elongated body with a top surface, bottom surface, front surface, back surface, and two opposing end surfaces;

a plurality of stripes disposed upon said front, top and back surfaces;

a least one stabilizer having a vertical element and a horizontal element, the vertical element of the stabilizer being disposed in a vertical channel defined between the top surface and the bottom surface of said body;

a cap disposed on the end of the vertical portion of said stabilizer;

wherein said body has a horizontal channel defined in said bottom surface, the horizontal channel being connected to said vertical channel and being parallel to said front surface; and wherein a slot is defined in the bottom surface of said body running between said front surface and said back surface, said slot being disposed so as to connect with said vertical channel.

2. A golf aid, comprising:

a horizontally elongated body with a top surface, bottom surface, front surface, back surface, and two opposing end surfaces, the body further having two vertical channels defined therein, said vertical channels running from the top surface to the bottom surface of said body;

two stabilizers each having a vertical element and a horizontal element, the vertical element of each stabilizer being disposed in one said vertical channel defined is said body;

a cap disposed on the end of the vertical portion of each said stabilizer;

wherein said body has two horizontal channels defined in said bottom surface, the horizontal channels each being connected to one said vertical channel and being parallel to said front surface; and wherein two slots are defined in the bottom surface of said body running between said front surface and said back surface, the slots being disposed so each connects with one said vertical channel.

3. A golf aid as in claim 2, wherein said stabilizers are T-shaped.

4. A golf aid as in claim 2, wherein said stabilizers are L-shaped.

5. A golf aid as in claim 2, wherein said body is composed of high-density structural foam polyethylene.

6. A golf aid, comprising:

two horizontally elongated bodies each with a top surface, bottom surface, front surface, back surface, and two opposing end surfaces, each body further having a vertical channel defined therein, said vertical channel running from the top surface to the bottom surface of each said body;

two stabilizers each having a vertical element and a horizontal element, the vertical element of each stabilizer being disposed in one said vertical channel defined is one said body;

a cap disposed on the end of the vertical portion of each said stabilizer;

a hinge, said hinge being disposed between one said end of each said body;

wherein each said body has a horizontal channel defined in said bottom surface, the horizontal channel being connected to one said vertical channel and being parallel to said front surface; and wherein two slots are defined in the bottom surface of said body running between said front surface and said back surface, the slots being disposed so each connects with one said vertical channel.

7. A golf aid as in claim 6, wherein said body is composed of high-density structural foam polyethylene.

* * * * *